US008194866B2

(12) United States Patent
Smith

(10) Patent No.: US 8,194,866 B2
(45) Date of Patent: Jun. 5, 2012

(54) SOUND MONITORING, DATA COLLECTION AND ADVISORY SYSTEM

(76) Inventor: Christopher M. Smith, New Palestine, IN (US)

( * ) Notice: Subject to any disclaimer, the term of this patent is extended or adjusted under 35 U.S.C. 154(b) by 950 days.

(21) Appl. No.: 12/195,366

(22) Filed: Aug. 20, 2008

(65) Prior Publication Data

US 2009/0052677 A1 Feb. 26, 2009

Related U.S. Application Data

(60) Provisional application No. 60/965,448, filed on Aug. 20, 2007.

(51) Int. Cl.
*H04R 29/00* (2006.01)

(52) U.S. Cl. ..... 381/56; 381/57; 381/58; 381/59; 381/77; 381/94.1; 381/73.1

(58) Field of Classification Search ..... 381/77, 381/58, 59, 56, 57, 94.1, 73.1
See application file for complete search history.

(56) References Cited

U.S. PATENT DOCUMENTS

| | | | | |
|---|---|---|---|---|
| 3,440,349 | A | 4/1969 | Gibbs | |
| 3,545,564 | A | 12/1970 | Barber | |
| 3,597,542 | A | 8/1971 | Thornton | |
| 4,277,980 | A | 7/1981 | Coats et al. | |
| 4,509,189 | A | 4/1985 | Simpson | |
| 6,098,463 | A | 8/2000 | Goldberg | |
| 6,117,076 | A | 9/2000 | Cassidy | |
| 7,021,142 | B2 | 4/2006 | Roark | |
| 2003/0013503 | A1 | 1/2003 | Menard et al. | |
| 2003/0226066 | A1 * | 12/2003 | Weddle et al. | 714/43 |
| 2007/0137281 | A1 | 6/2007 | Ichijo | |

OTHER PUBLICATIONS

Smith, Christopher M., Inventor Declaration Regarding Prior Systems, signed Feb. 11, 2009.

Quest Technologies; User Application News Note 3: Noise in Neonatal Intensive Care Units; Jan. 2002.

Balogh, D. et al., Abstract for "'Noise in the ICU', Intensive Care Medicine Journal, vol. 19, No. 6, pp. 343-346, Jun. 1993;" Springer Berlin / Heidelberg, http://www.springerlink.com/content/u411506r24166204/.

* cited by examiner

*Primary Examiner* — Tan N Tran
(74) *Attorney, Agent, or Firm* — Matthew R. Schantz; Bingham Greenebaum Doll LLP

(57) ABSTRACT

A sound monitoring system and method. The system can include a plurality of sound pressure level meters, a plurality of sound level indicators and a server connected by a network. The sound pressure level meters measuring a sound level at their location, and the sound level indicators providing a visual indication of the sound level measured by at least one of the sound pressure level meters. The system devices can be powered, as well as monitored and controlled remotely over the network. A user interface enables constructing and monitoring multiple zones and groups in a monitored area, as well as reviewing real-time and historical sound data. The system can also control lighting in the monitored area, and use lighting as a visual indicator of noise level.

3 Claims, 9 Drawing Sheets

SOUND MONITORING, DATA COLLECTION AND ADVISORY SYSTEM

CROSS-REFERENCE TO RELATED APPLICATIONS

This application claims the benefit of U.S. Provisional Application Ser. No. 60/965,448, filed on Aug. 20, 2007, entitled "Sound Monitoring and Data Collection, Analysis and Storage," which is incorporated herein by reference.

BACKGROUND AND SUMMARY

The present invention generally relates to an apparatus and methodology for monitoring and reporting acoustic levels, and more specifically to a system for monitoring and reporting sound levels in an area in order to control noise in that area.

The present system is a sound monitoring, data collection, and advisory system that provides empirical data and can provide visual cues to empower and facilitate un-biased control over noise levels. This enables a facility to maintain a desired acoustic level for employees, visitors, patients and/or others. The system's flexibility can meet any client's current needs and makes future system expansion easy and cost-effective. The system monitors the ambient noise level in the monitored area, collects data on characteristics of the noise, and provides a visual representation of the noise level. The system could be installed in environments that include, but are not limited to, hospital intensive care units, standard patient care areas (e.g. patient rooms), schools, libraries, museums, industrial facilities, sleep centers, academia, high security areas as a component of high-end security systems, or anywhere else sound control is desired.

Excessive noise can compromise a newborn's well-being and negatively impact an infant's growth and development. For these reasons, it is especially important to control sound levels in a neo-natal intensive care unit (NICU). The present system facilitates compliance with developing NICU noise control standards, and can be reconfigured easily as those standards evolve. The medical industry in general, and NICU's in particular, are experiencing rapid growth due to advances in technology and medical science. The NICU standard for noise control has evolved and matured over the last several years. More is known by doctors, nurses, specialists, and educators about the effects of excessive noise on infants in NICU's and on other individuals. The science is telling in that most if not all indicators show an urgent need for hospitals to take sound control seriously.

Technology has progressed rapidly resulting in the steady infusion of new equipment making more and more ambient noise. Alarms, monitors and communication systems all contribute to the rise in ambient noise. As the ambient noise level rises, staff noises and voices also rise as they compete to be heard. This vicious cycle of rising sound levels can be detrimental to the living and working environment of people.

The sound level can be measured in decibels (dB), which is a logarithmic unit of measurement that expresses the magnitude of a physical quantity relative to a specified or implied reference level. The difference in decibels between the power of two sounds is $10 \log_{10} (P2/P1)$ dB. Since it expresses a ratio of two quantities with the same units, it is a dimensionless quantity. When the decibel is used to give the sound level for a single sound rather than a ratio, then a reference level must be chosen. For sound intensity, the reference level (for air) is usually chosen as 20 micropascals, or 0.02 mPa, which is the threshold of human hearing, the lowest sound pressure level at which the human ear can detect sound. For acoustic (calibrated microphone) measurements, the response can be set such that 20 μPa=0 dB.

Not all sound pressures are equally loud. This is because the human ear does not respond equally to all frequencies. Loudness is not the same thing as sound intensity, and there is not a simple relationship between the two, because the human hearing system is more sensitive to some frequencies than others. Furthermore, the frequency response of the human hearing system varies with loudness, as has been demonstrated by the measurement of equal-loudness contours. Humans are more sensitive to sounds in the frequency range of about 1 kHz to 4 kHz than to lower or higher frequency sounds.

For these reasons, sound meters are often fitted with a filter that has a frequency response modeled to reduce the contribution of low and high frequencies in order to produce a reading which corresponds approximately to what we hear. A filter response commonly used to model human hearing is the A-weighting filter defined in the International standard IEC61672:2003. A-weighting is the most commonly used of a family of curves defined in IEC179 and various other standards relating to the measurement of perceived loudness, as opposed to actual sound intensity. A-weighted decibels are abbreviated dB(A) or dBA. When acoustic (calibrated microphone) measurements are being referred to, then the units used will be dB SPL (sound pressure level) referenced to 20 micropascals=0 dB SPL. A-weighting is also in common use for assessing potential hearing damage caused by loud noise. Although the threshold of hearing is typically around 0 dB SPL, most common appliances are likely to have noise levels of 30 to 40 dB SPL.

To better characterize the sound, an FFT (Fast Fourier Transform) may be performed. The Fourier transform is a method for reducing a sample of audio spectral content to a compact data set. These data sets can be stored and recalled and utilized as a method of describing acoustical events within an area with a minimum amount of data. This data set is comparable to a Bode magnitude plot and can support various levels of resolution, for example there can be 128 or 1024 data per set to describe an acoustic event.

DESCRIPTION OF EXEMPLARY EMBODIMENTS

The exemplary embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

The sound monitoring system disclosed can be used in Neonatal Intensive Care Units (NICU) and other environments to minimize excessive sound levels. The sound monitoring system monitors sound levels and provides empirical data and visual cues to empower staff and facilities to identify and control noisy activities. When optimized, the system lowers the sound level environment for employees, visitors and/or patients by assisting in behavior modification. The sound monitoring system is optimized with data archiving, analysis, and graphical representation software to provide a powerful tool for in-depth sound events research.

Figure 1:
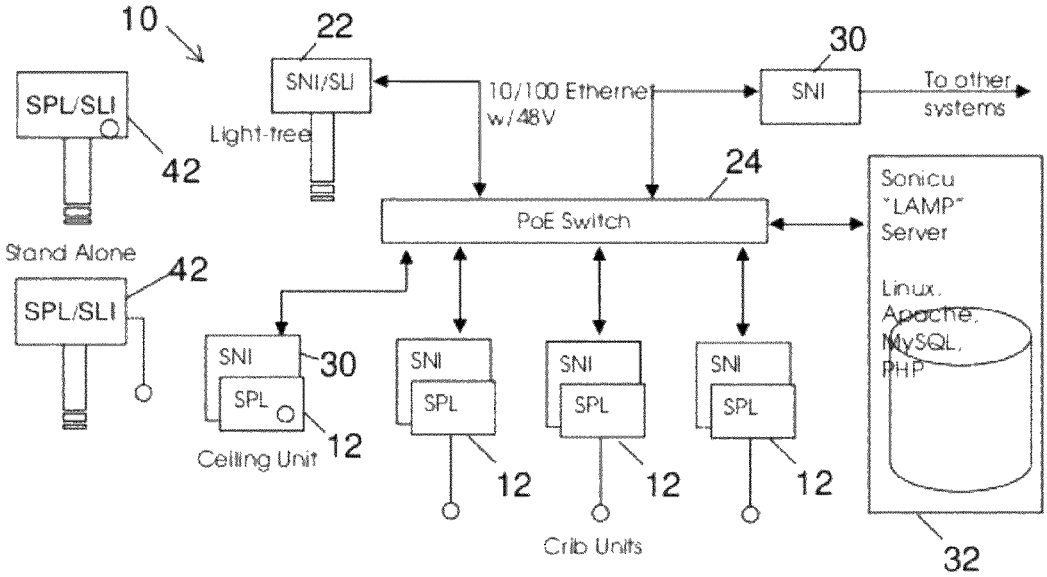
FIG. 1 is a schematic illustrating a hardware layout for an exemplary embodiment of a sound monitoring system.

FIG. 1 illustrates an exemplary embodiment of a sound monitoring system 10 that includes a network of devices providing real-time status of sound pressure levels in one or more monitored areas. These devices can include sound pressure level (SPL) meters 12 and sound level indicators (SLI) 22 that are networked to system server 32 utilizing system network interfaces (SNI) 30. The network interfaces can utilize wired or wireless connectivity. These devices can be networked over Ethernet and can be powered over the Ethernet connection by Power over Ethernet (POE) hardware 24. The sound monitoring system 10 can also include stand alone sound pressure level meters 12 and sound level indicators 22 that can indicate sound levels independent of a network.

FIG. 1 also illustrates that the sound pressure level meters 12 and sound level indicators 22 can be implemented in different configurations. The stand alone sound pressure level meters and associated sound level indicators can be packaged as a single device 42 or as separate sound pressure level meters 12 and sound level indicators 22 connected together through wired and/or wireless methods. The sound pressure level meter 12 can be configured for different applications, for example in a wall mount configuration, a ceiling mount configuration or a crib mount configuration, which would be especially useful in a NICU environment.

Figure 2:
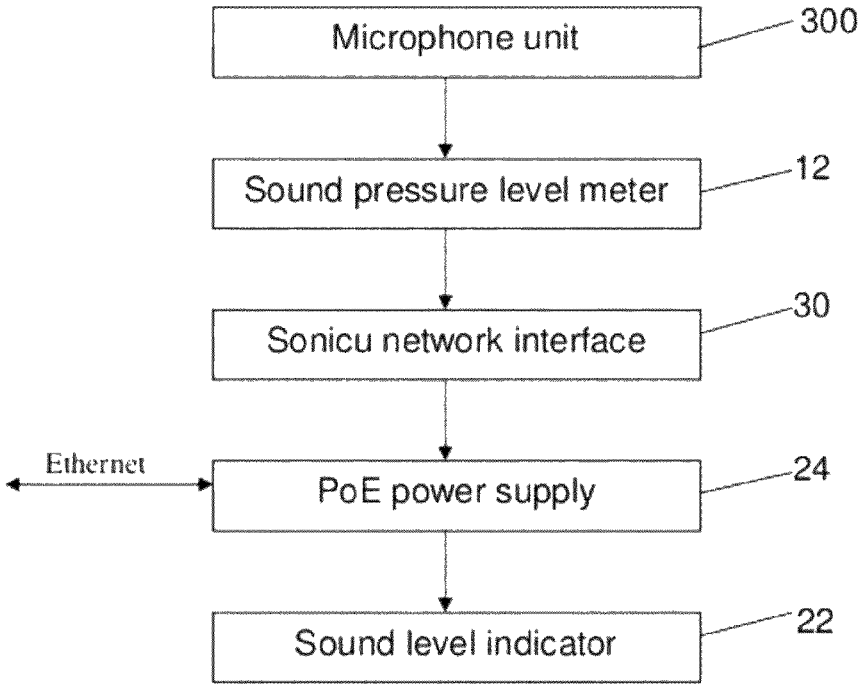
FIG. 2 shows a very top-level view of some of the key components and possible interconnections of an exemplary networked embodiment of a sound monitoring system.

FIG. 2 shows a very top-level view of some of the key components and possible interconnections of an exemplary networked embodiment of a sound monitoring system. A microphone unit 300 can be wall, ceiling or crib mounted, has a warning indicator and carries a unique identifier. The microphone unit 300 is connected to a sound pressure level meter 12. The sound pressure level meter 12 measures and reports sound pressure and spectral content. In networked mode, the sound pressure level meter 12 can be connected to a network interface 30. The network interface 30 provides system-wide configuration, control and data access. The network interface 30 can be connected to a power-over-Ethernet power supply 24. The power-over-Ethernet power supply 24 is a universal power supply allowing for simple and flexible installation of the sound monitoring system 10. The power-over-Ethernet power supply 24 is connected to an Ethernet network as well as to networked sound level indicators 22. The sound level indicators 22 provide a visual indication of the detected sound level.

The Power over Ethernet hardware 24 includes a circuit assembly that receives input power and redistributes that power to the other devices, including sound pressure level meters 12 and sound level indicators 22 on the network through the Ethernet connection. The Power over Ethernet hardware 24 is designed to have a wide variance for input power and to be deployable most anywhere in the world. The Power over Ethernet hardware 24 can utilize a wall transformer with an industry standard power jack to power the system devices or they can be powered over Ethernet. In addition, the power supply can be run on 50 or 60 Hz input power.

The system software provides the user with an interface into the network of devices in the sound monitoring system 10. This user network interface can provide the user with various capabilities, including the ability to configure the system; to monitor real-time system status and sound pressure levels; to record and playback sound pressure level readings; and/or to install system firmware upgrades. The system server 32 can be used to receive, interpret and store the inputs from the sound pressure level meters 12, and to coordinate the outputs of the sound level indicators 22. The embodiment of the system server software shown in FIG. 1 is based on the LAMP suite of open source software packages, which includes the Linux operating system, Apache web server, MySQL database and PHP based web pages. The sound monitoring system 10 can support multiple levels of users. Logins and passwords can be utilized to establish what permissions a user has while using the system.

Upon power-up, the networked devices of the sound monitoring system 10 can use the dynamic host configuration protocol (DHCP) to obtain various parameters necessary to operate in an internet protocol (IP) network, including an IP address. After gaining an IP address, each device contacts the server 32 to 'check-in' and register their serial numbers. Each device has a unique serial number. The user can also assign names to each device and the system 10 will maintain a list of the devices with their associated serial numbers, names and current IP addresses. The devices have additional configuration properties according to their device type.

Figure 3:
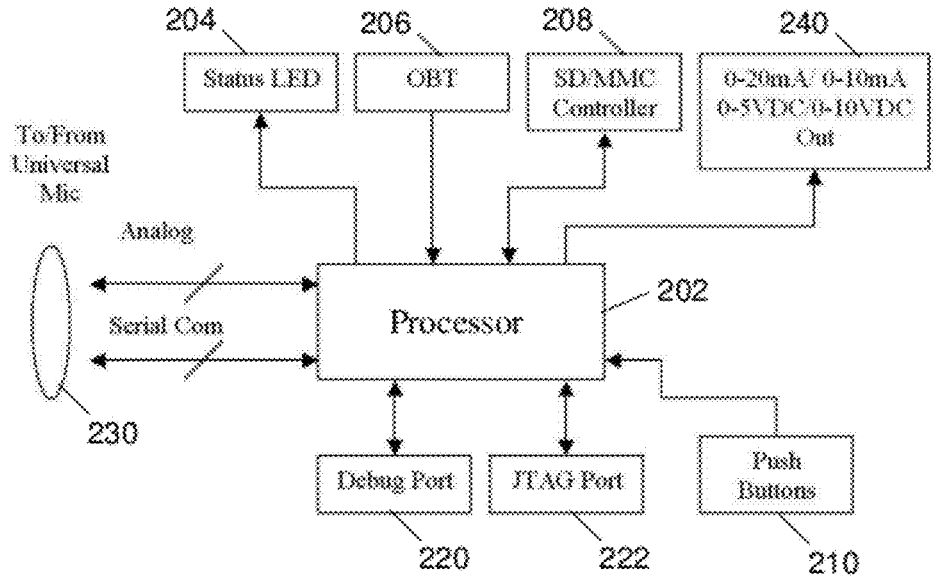
FIG. 3 is a schematic illustrating a hardware layout for an exemplary embodiment of a sound pressure meter.

A hardware block diagram for an embodiment of a sound pressure level meter 12 is shown in FIG. 3. This embodiment of the sound pressure level meter 12 includes a processor 202 which is connected to a universal microphone interface 230, a status LED 204, an on-board temperature sensor 206, a multimedia card interface 208 and one or more push buttons 210. The processor 202, which can be a digital signal processor (DSP), also includes a debug port 220 and a JTAG test access port 222. The processor 202 also includes output lines 240 for sending sound pressure information to the server 32, if operating in networked mode, or an associated sound level indicator 22, if operating in stand alone mode.

A sound pressure level meter 12 can operate in networked or stand alone mode. In networked mode, the sound pressure level meter 12 communicates with the server 32 and the server 32 receives and stores sound pressure data and updates the outputs of the sound level indicators 22. In stand alone mode, the sound pressure level meter 12 is usually associated with a sound level indicator 22 so that the sound pressure level meter 12 can process and store the sound pressure data and the associated sound level indicator 22 can indicate the sound level.

Each sound pressure level meter 12 has an associated name, which defaults to "SPL" with a numeric value appended but can be edited by the user. This name is used throughout the control software to represent the sound pressure level meter 12 to the user.

The status LED 204 of the sound pressure level meter 12 can be used to indicate the status of the sound pressure level meter 12 based on the color and blinking rate of the status LED 204. One color and blinking rate can indicate that the sound pressure level meter 12 is attempting to obtain an IP address, another to indicate that it has obtained an IP address and is attempting to connect to the server 32, and yet another to indicate that it has a valid connection to the server 32. If the server connection is lost for a predetermined time, for example more than ten seconds, the status LED 204 can indicate loss of connection until the sound pressure level meter 12 can regain connection to the server 32.

The on-board temperature sensor 206, which interfaces with the processor 202, indicates the internal temperature of the sound pressure level meter 12. The multimedia card interface 208 can be used to load new software or parameters onto the sound pressure level meter 12 or to download information from the sound pressure level meter 12. The embodiment shown in FIG. 3 uses a secure digital (SD) memory card. The push buttons 210 can include one or more push buttons that interface with the processor 202. The push buttons 210 can include a reset pushbutton for the sound pressure level meter 12 or other special function pushbuttons. The debug port 220 and JTAG test access port 222 are used for debugging and testing the sound pressure level meter 12.

Figure 4:
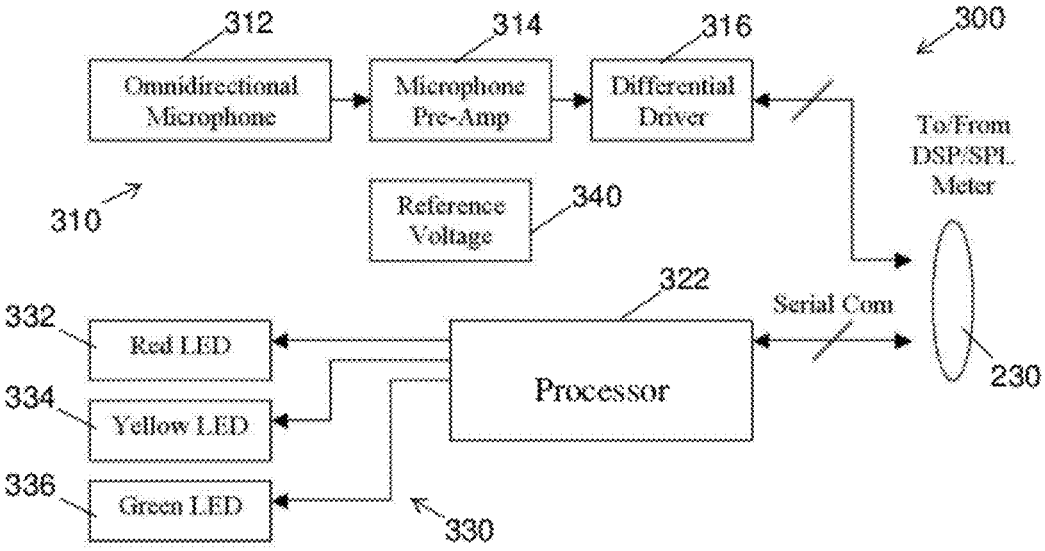
FIG. 4 is a schematic illustrating a hardware layout for an exemplary embodiment of a universal microphone input board.

The universal microphone interface 230 interfaces between the sound pressure level meter 12 and a universal microphone input board 300 (see FIG. 4). The universal microphone input board 300 generates the microphone signal which is sent through the universal microphone interface 230 to the sound pressure level meter 12. The output lines 240 can send the output of the sound pressure level meter 12 in different formats that can be user programmable. Exemplary output formats include a filtered pulse-width modulated current output with a 0-20 mA or a 0-10 mA range; or a voltage output with a 0-5 VDC or a 0-10 VDC range.

The firmware of the sound pressure level meter 12 can operate in stand-alone mode or network mode. Upon power-up the sound pressure level meter 12 detects whether or not it is connected to a network interface 30. If a network interface 30 is present, the sound pressure level meter 12 will operate in network mode. If no network interface 30 is present, then the sound pressure level meter 12 will operate in stand-alone mode.

In stand-alone mode, the firmware on the sound pressure level meter 12 digitally filters audio input from the universal microphone input board 300 and outputs a signal proportional to the peak signal detected during the filtering. This peak signal can be used as an output to control an associated sound level indicator 22 to visually represent the level of sound detected.

In network mode, the firmware on the sound pressure level meter 12 digitally filters audio input from the universal microphone input board 300 and reports the sound pressure levels back to server 32 through the network interface 30. When requested by the server 32, the sound pressure level meter 12 can also provide frequency domain values back to the server 32.

The sound pressure level meter 12 has three communication ports. Data integrity measures can be implemented on these ports to help ensure accurate communication. For example, all packets received can be responded to with an Acknowledgement response if the calculated checksum matches the received checksum. In the event that the checksum calculated does not match the received checksum, the receiving device will not send an Acknowledgement response. If the sending device does not receive the Acknowledgement response, it can resend the entire packet.

A first communication port is between the sound pressure level meter 12 and the universal microphone input board 300. This port can be used for various reasons, including to update LED settings on the universal microphone input board 300; to read from or write to the memory on the universal microphone input board 300; or to command the universal microphone input board 300 to enter a calibration state.

A second communication port is between the multimedia controller 208 and the processor 202. This port can be used for various reasons, including to request configuration settings from a multimedia card, or for bootloading commands and associated data.

A third communication port is between the processor 202 and the system network interface 30. This port can be used for various reasons, including for passing information to the server 32, such as the serial number, firmware versions or status of the sound pressure level meter 12 or the universal microphone input board 300; for bootloading commands and associated data; for receiving configuration settings from the server 32; or for sending sound pressure level data to the server 32 in either time or frequency domain formats.

The sound pressure level meter 12 is bootloadable from either the multimedia controller socket 208 or from the server 32 through the system network interface 30. When bootloading from the multimedia controller socket 208, the firmware can be updated depending on the mode of the sound pressure level meter 12, for example, (a) only if the sound pressure level meter 12 is operating in stand-alone mode (no system network interface 30 detected), or (b) regardless of the operating mode (stand-alone or networked). This choice can be selectable by different methods, including for example by using different file names based on whether the file is to be updated only in standalone mode or regardless of mode. When operating in networked mode, the sound pressure level meter 12 firmware can also be updated through the system network interface 30. The sound pressure level meter 12 can store the time/date information from the application file that was most recently loaded.

The universal microphone input board 300, or UMI, is usually a subsection of the sound pressure level meter 12. The universal microphone input board 300 converts sound frequencies and pressure levels to an analog signal and sends the analog signal to the sound pressure level meter 12. A hardware block diagram of an embodiment of a universal microphone input board 300 is shown in FIG. 4. This embodiment of the universal microphone input board 300 includes an audio chain 310, a microprocessor 322, a meter level indicator 330 and a reference voltage 340. The audio chain 310 includes an omni-directional microphone 312 which is connected to a microphone pre-amplifier 314 which is connected to a differential line driver 316 which provides the audio signal sent to the sound pressure level meter 12 through the universal microphone interface 230. The meter level indicator 330 includes three indicator LEDs: a red LED 332, a yellow LED 334 and a green LED 336.

The microprocessor 322 communicates with the sound pressure level meter 12 through the serial lines of the universal microphone interface 230. The microprocessor 322 can also store information useful for identification, initialization and calibration of the universal microphone input board 300. In the exemplary embodiment, each universal microphone input board 300 has a unique 4-byte identification number and a date code. Communications between the sound pressure level meter 12 and the universal microphone input board 300 across the universal microphone interface 230 can be used to retrieve data about the audio chain 310, and to send data about the state of the LEDs in the meter level indicator 330.

The LEDs 332, 334, 336 of the meter level indicator 330 can provide a local indication of the sound pressure level sensed by the sound pressure level meter 12. The sound pressure level meter 12 can send feedback to the microprocessor 322 on the universal microphone input board 300 on what the status of the LEDs in the meter level indicator 330 should be, and the microprocessor 322 can light the LEDs 332, 334, 336 based on this feedback.

Figure 6:
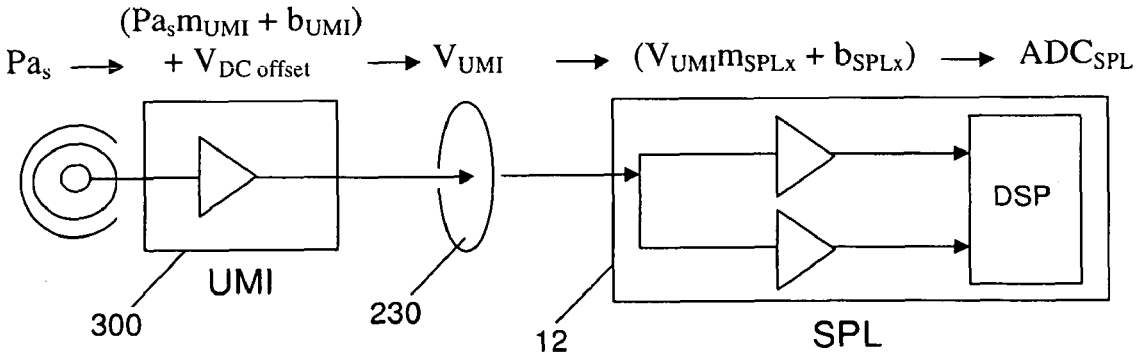
FIG. 6 illustrates a signal flow diagram for an exemplary method of a system calibration procedure.

Configuration parameters can be used to set various user modifiable options for the sound pressure level meter 12 and universal microphone input board 300. An exemplary configuration interface 500 for setting configuration parameters for an embodiment of a sound pressure level meter 12 is shown in FIG. 6. In this embodiment the configuration interface 500 includes the following configuration parameters:

(a) Output Type—selects output type of the analog output 240 of the sound pressure level meter 12, either volts (V) or milliamps (mA);

(b) Output Range—selects the output range on the analog output 240 for the output type selected;

(c) Minimum Output Value—sets the minimum dB(A) level that will provide an output level, the output level in V or mA (depending on the Output Type selection) is then selected for that dB(A) value (any levels below the minimum dB(A) level are set to the minimum dB(A) level setting);

(d) Maximum Output Value—sets the maximum dB(A) level that will provide an output level, the output level in V or mA (depending on the Output Type selection) is then selected for that dB(A) value (any levels above the maximum dB(A) level are set to the maximum dB(A) level setting);

(e) Calculated Slope and Offset—these values are shown for informational purposes, they are used by the sound pressure level meter 12 to calculate the output value and are not directly modifiable by the user;

(f) Analog Output Falloff Time—represents the level of averaging performed on the analog outputs which affects how quickly the last detected peak decays away (Increasing the number slows down the response rate of the analog output (so spikes are less apparent), and decreasing the number speeds up the response rate of the analog output.);

(g) Threshold Levels (30 to 120 dB(A))—minimum dB(A) measurement required to light the corresponding light on the sound level indicator 12 or meter level indicator 330 (default of 50 dB(A) to light Yellow and 70 dB(A) to light Red);

(h) Minimum SLI Light "ON" Time (0 to 15 seconds)—minimum amount of time a sound level indicator 22 or meter level indicator 330 light corresponding to a particular sound level remains on before turning off again after the stimulus sound stops (default of 5 seconds); and (i) Minimum Acquisition Time (0 to 10 seconds)—minimum amount of time a sound must be above a certain threshold before the sound level indicator 22 or meter level indicator 330 status is updated (default of 3 seconds).

Figure 5:
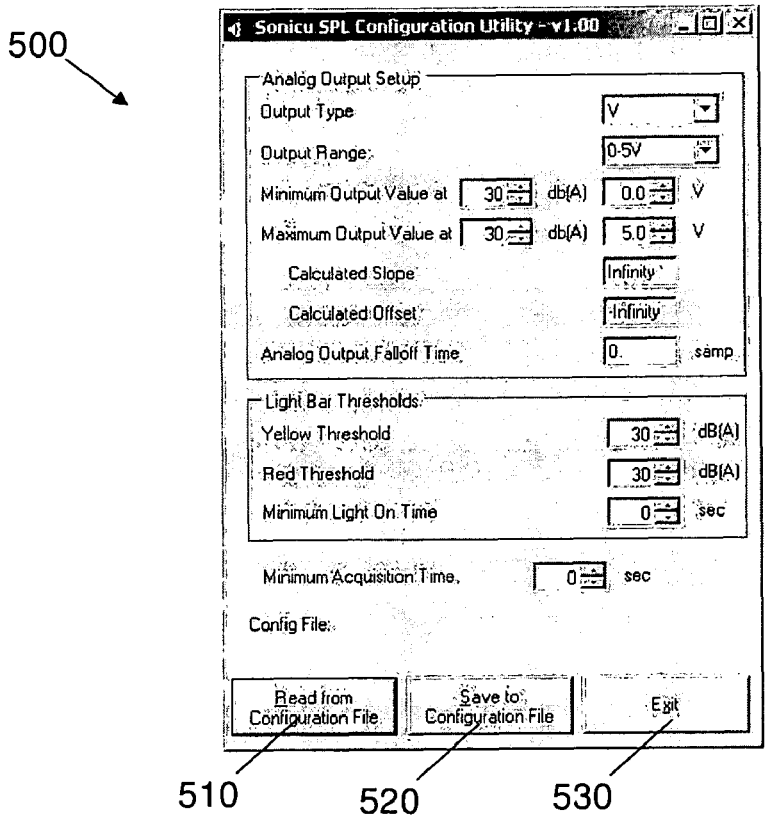
FIG. 5 illustrates an exemplary configuration interface window for a sound pressure meter.

The configuration interface 500 shown in FIG. 5 can be used to read and/or update the configuration parameters in a configuration file. By selecting the "Read from Configuration File" button 510, the user is presented with a file selection window from which the user can browse to the desired file location, select the desired file and populate the configuration interface window 500 with the values from the desired configuration file. By selecting the "Save to Configuration File" button 520, the user is presented with a file selection window from which the user can browse to the desired file location to select a configuration file to be updated with the configuration parameters shown in the configuration interface window 500. By selecting the "Exit" button 530, the configuration interface window 500 is closed.

When operating in networked mode, the configuration parameters for the sound pressure level meter 12 are received from the server 32 to coordinate the configuration of monitored areas. In networked mode, only the following configuration values are needed by the sound pressure level meter 12: dB(A) Level Range, dB(A) Threshold Levels, Minimum Acquisition Time, and Minimum SLI Light "ON" Time. When operating in stand-alone mode, the configuration parameters for the sound pressure level meter 12 can be updated from a multimedia card inserted into the multimedia controller socket 208.

For calibration purposes, the sound pressure sensing can be divided at the universal microphone interface 230 between the universal microphone input board 300 and the sound pressure level meter 12. This allows the sound pressure level meter 12 to adopt new calibration values when a universal microphone input board 300 is changed.

FIG. 6 illustrates a signal flow diagram for an exemplary embodiment of a system calibration procedure. The exemplary calibration procedure is used with an embodiment of the sound monitoring system having a universal microphone interface 230 between a universal microphone input board (UMI) 300 and a sound pressure level (SPL) meter 12. The UMI 300 receives a sound pressure level, which can be measured in Pascals (Pa), processes it, and outputs a corresponding signal, which can be a voltage $V_{UMI}$, to the universal microphone interface 230. The SPL meter 12 receives the voltage $V_{UMI}$ at the universal microphone interface 230, processes it, and output a corresponding signal, which can be a digital count value $ADC_{SPL}$. Of course, other methods can be used to communicate the sound pressure level to the system.

In this exemplary calibration procedure, the gains of the UMI 300 and the SPL meter 12 are independent of each other and can therefore be determined during a factory calibration and stored on each device respectively. However, the system offset is dependent upon both the SPL meter 12 and UMI 300 together and is therefore found after the devices are connected. This is done during each power-up of the system of devices.

The calibration steps in this exemplary procedure are:

SPL meter 12 offset calibration;

SPL meter 12 factory gain calibration;

UMI 300 factory response curve calibration (partial); and

UMI 300 response curve calibration (complete) and SPL meter 12 with UMI 300 offset calibration, in the field.

In this exemplary calibration procedure, the offset calibration for the SPL meter 12 is performed using the following procedure. During power up, or when a new UMI 300 is detected, the SPL meter 12 sends a calibration command to the UMI 300 along with the amount of time that the microphone input of the UMI 300 should remain in shorted mode. If no UMI is present, then the inputs are already in their correct state. While the microphone input is shorted or with no UMI 300 connected, the input signal to the SPL meter 12 is in a known zero state ($V_{UMI}$=0 V). During this time period, the SPL meter 12 gathers ADC data to determine the DC offsets for the high and low gain input channels of the SPL meter 12. The DC offsets are determined by the average of 1000 samples of each channel and are stored in memory as: $ADC_{0H}$ and $ADC_{0L}$, respectively. These count offset values are automatically subtracted from each count reading by the SPL meter 12 before use by the rest of the firmware. The ADC values referenced in the remainder of this document are assumed to already have these offsets applied, unless indicated otherwise.

In this exemplary calibration procedure, the gain calibration for the SPL meter 12 is performed can be performed at the factory using the following procedure. The sound pressure level meter 12 can use multiple channels to characterize sound levels over the desired range. The embodiment for exemplary calibration procedure uses two channels over the dB range. Each channel has its own calibration information. The calibration values are a mathematical representation of the SPL meter 12 converting a voltage level, $V_{UMI}$, from the UMI 300 to A/D counts (ADC) within the processor 202 and can be written as:

$$ADC_{SPL}=V_{UMI}*AV$$

where $ADC_{SPL}$ is the A/D counts output by the SPL meter 12 and AV is the gain factor for the channel. Note that the ADC offset, $ADC_0$, for the channel is included in the $ADC_{SPL}$ value.

The calibration values for the sound pressure level meter 12 are calculated by presenting each channel with two DC voltage levels. Each DC voltage level is applied by grounding the Mic− input on the SPL meter 12 and applying the specified voltage level to Mic+ input. As each voltage level is applied, the SPL meter 12 samples the voltage level and stores an averaged ADC value for the given voltage level. To calibrate the low gain channel, levels of $V_{0L}$=0.0 V (ground) and $V_{HL}$=12.8 mV are applied to the inputs and averaged ADC values $ADC_{0L}$ and $ADC_{HL}$ are determined, respectively. To calibrate the high gain channel, levels of $V_{0H}$=0.0 V (ground) and $V_{HH}$=771 mV are applied to the inputs and averaged ADC values $ADC_{0H}$ and $ADC_{HH}$ are determined, respectively. After all four voltage levels have been applied; the sound pressure level meter 12 calculates the gain for each channel. The gain for the low gain channel is calculated as $$AV_L=(ADC_{LL}-ADC_{0L})/(V_{HL}-V_{0L})$$

and the gain for the high gain channel is calculated as $$AV_H=(ADC_{HH}-ADC_{0H})/(V_{HH}-V_{0H})$$

where each of the $V_{0L}$ and $V_{0H}$ values is the voltage when shorted to ground, thus $V_{0L}=V_{0H}$=0 V. The DC offset counts for the SPL meter 12, $ADC_{0L}$ and $ADC_{0H}$, are shown explicitly in these equations.

In this exemplary calibration procedure, the gain of the UMI 300 is partially determined at the factory. The conversion from sound pressure level in Pascals to volts is calculated by applying a known input dB(A) level to the universal microphone input board 300 and, using a calibrated sound pressure level meter 12, back-calculating the voltage level at the universal microphone interface 230, $V_{UMI}$. When the UMI 300 to be calibrated is connected to the SPL meter 12, the SPL meter 12 performs the offset calibration explained above to determine the offsets, $ADC_{0H}$ and $ADC_{0L}$, for the combination with the UMI 300. In the exemplary calibration procedure, a 1 kHz sine wave output from a Klipsch KM-4 speaker is used as the calibration stimulus in an anechoic chamber, and an Extech 407768 Auto Ranging Sound Level Meter in A-weighted mode is used to confirm the known dB(A) level applied to the universal microphone input board 300. In this exemplary procedure, the output counts from the high gain channel of the SPL meter 12 ($ADC_{SPL90}$) is measured when the calibration stimulus has a signal strength of 90 dB(A) on the Extech Sound Level Meter. The voltage level at the universal microphone interface 230, $V_{UMI90}$, for this sound level is then back calculated by the SPL meter 12 by factoring out its own gain on the signal using the equation:

$$V_{UMI90}(ADC_{SPL90}-ADC_{0H})/AV_H$$

this 90 dB(A) voltage level, $V_{UMI90}$, is stored in the UMI 300. This is the upper value for the gain calculation of the UMI 300.

The final step of the exemplary calibration procedure are the field calibrations of the combined offset for the SPL meter 12 and UMI 300, and the response curve for the UMI 300. This is done automatically, upon each power-up of the SPL meter 12 or when a new UMI 300 is detected in the field. As described above, on power-up or when a new UMI 300 is detected, the SPL meter 12 sends the UMI 300 a calibration command to short the microphone inputs. During this time the average system noise generated on each gain channel can be determined by averaging ADC readings on each gain channel for a span of 3 seconds, $ADC_{0L}$ and $ADC_{0H}$. The resulting average is considered noise induced by the system. In the exemplary calibration procedure, the calibration point for the low gain channel, $ADC_{0L}$, is also used as the minimum measurable signal obtainable by the SPL meter 12 and UMI 300 which is assumed to be associated with an input sound level of 30 dB(A) based on empirical measurements. The voltage level at the universal microphone interface 230, $V_{UMI30}$, for this minimum sound level is then back calculated by the SPL meter 12 by factoring out its own gain on the signal using the equation:

$$V_{UMI30}=ADC_{0L}/AV_L$$

This is the overall offset voltage for the combined SPL meter 12 and UMI 300 which is stored by the system.

Also during power up, or when a new UMI 300 is detected, the SPL meter 12 will send a command to the UMI 300 to retrieve the factory calibration value $V_{UMI90}$ stored in the UMI 300. Using the offset above the slope, $m_{UMI}$, and offset, $b_{UMI}$, of the response curve for the UMI 300 can be calculated as:

$$m_{UMI}=(P_{90}-P_{30})/(V_{UMI90}-V_{UMI30}), \text{ and}$$

$$b_{UMI}=P_{90}-V_{UMI90}*m_{UMI}$$

where $P_{90}$ and $P_{30}$ are the sound pressure levels in Pascals for the 90 dB(A) and 30 dB(A) inputs to the UMI 300.

Using the results of this exemplary calibration procedure, the sound pressure level $P_X$ for a given count reading $ADC_X$ by the SPL meter 12 and UMI 300 can be calculated for each gain channel. For the low gain channel, the sound pressure level $P_{XL}$ for a given count reading $ADC_{XL}$ can be calculated by first calculating the voltage at the universal microphone interface:

$$V_{UMIXL}=(ADC_{XL}-ADC_{0L})/AV_L$$

and then calculating the pressure using the UMI response curve:

$$P_{XL}=m_{UMI}*V_{UMIXL}+b_{UMI}$$

The decibel value can then be calculated using:

$$db_{XH}=20*\log(P_{XL}/P_R)$$

where $P_R$ is the sound pressure level at the threshold of human hearing (0.02 mPa).

For the high gain channel the sound pressure level $P_{XH}$ for a given count reading $ADC_{XH}$ can be calculated by first calculating the voltage at the universal microphone interface:

$$V_{UMIXH}=(ADC_{XH}-ADC_{0H})/AV_H$$

and then calculating the pressure using the UMI response curve:

$$P_{XH}=m_{UMI}*V_{UMIXH}+b_{UMI}$$

The decibel value can then be calculated using:

$$db_{XH}=20*\log(P_{XH}/P_R)$$

The point at which the system should switch from the high gain channel to the low gain channel can also be calculated. If the ADC value at the top of the high gain channel is to be approximately 90% of the maximum possible rectified counts, the cross-over point for the system can be calculated as:

$$COP\ \text{dB}=20\ \log(0.9*AV*((P-b_{UMI})/m_{UMI})_{rectified\ max}/\text{Pr})$$

Whenever the sound pressure level meter 12 detects a new analog input peak, the decibel level of the sound is calculated using the ratio of the sample sound to the memorized A/D counts at the threshold of hearing for the system, which is:

$$y\ \text{dB}=20\ \log(AV*((P-b_{UMI})/m_{UMI})/Pr)$$

Figure 7:
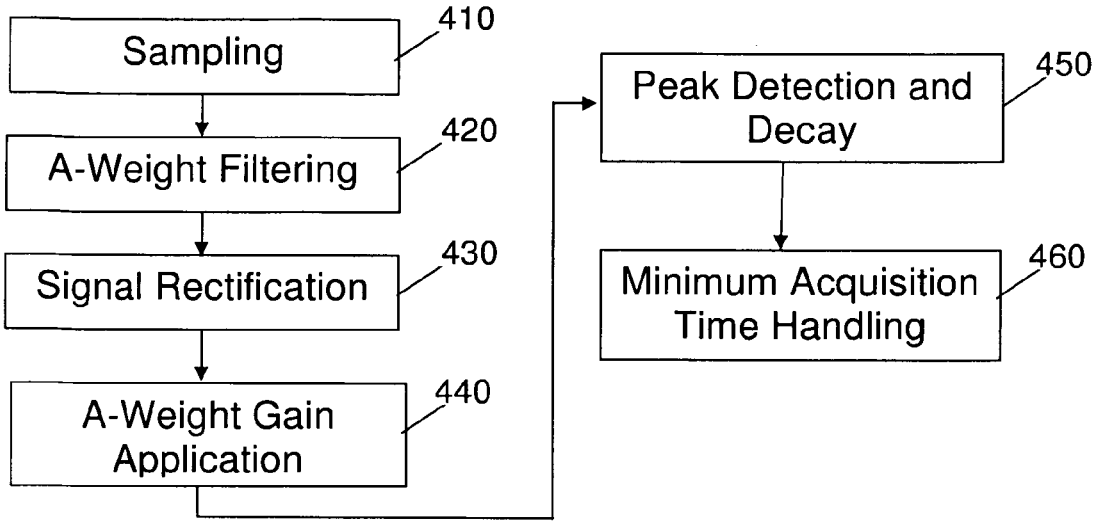
FIG. 7 illustrates a flow diagram for an exemplary method of processing audio signals received by the universal microphone input board.

FIG. 7 shows an exemplary method for processing the audio signals received by the universal microphone input board 300 when finite Fourier transforms are not used by the sound monitoring system 10.

In block 410, the audio signal from the universal microphone input board 300 is sampled. In the current embodiment the signal is sampled at a rate of 80 kHz (one sample taken every 12.5 μs). The sample is digitized as a 12-bit representation of the signal, ranging from 0 to 4095 (with 0 to 2048 representing −1.5 VDC to 0 VDC and 2048 to 4095 representing 0 VDC to 1.5 VDC), giving the ADC a resolution of 732.6 μV. Control is then passed to block 420.

In block 420, the sampled signal is passed through an A-weighted digital filter. In the current embodiment, the sampled signal is input into the Texas Instruments 16-bit infinite impulse response (IIR) filter taken from the C28xx Foundation Software Filter Library. The coefficients for the filter are derived such that the output from the filter will take on the band pass characteristics of the typical A-weighted curve, including a lower cutoff frequency of 700 Hz, an upper cutoff frequency of 9000 Hz, a resonant frequency of 2500 Hz, and a 20 dB/decade roll off. Control is then passed to block 430.

In block 430, the A-weighted signal is rectified. In the current embodiment, the output of the A-weight filter is a 12 bit signed number ranging from −2047 to 2047. The filter characteristics remove the DC offset. Taking the absolute value of the output then rectifies the signal. Control is then passed to block 440.

In block 440, an A-Weight gain is applied to the signal. In the current embodiment, the A-weight filter produces an output that actually contains a 2 dB loss across the frequency spectrum. A gain constant is used to correct for this loss. Each output from the filter is multiplied by 1.10649. Control is then passed to block 450.

In block 450, after the signal is digitally filtered, rectified, and amplified, it is examined to see if the signal level has exceeded the last stored peak level. If the signal level is greater than the last stored peak value, the signal level is stored as the new peak value. If the signal level is less than the last stored peak value, then the last stored peak value is decayed by multiplying it by a decay factor. In the current embodiment, the decay factor is determined by the Analog Output Falloff Time (AOFT) configuration parameter and is calculated by $$\text{DecayFactor}=50\%/(10^{AOFT+1})$$

Control is then passed to block 460.

In block 460, the minimum acquisition time setting is taken into account. In the current embodiment, the highest peak value detected during every 200 ms (16,000 samples) is stored in an array. The size of the array is determined by the Minimum Acquisition Time configuration parameter and is calculated by $$\text{ArraySize}=5*\text{MinimumAcquisitionTime}$$

The average of the array is then taken, to reflect the average peak value over the duration of the Minimum Acquisition Time specified by the configuration. If the dB calculation of this average exceeds either the Yellow Threshold or the Red Threshold specified by the configuration, then the appropriate light is activated on the microphone level indicator 330. If the sound pressure level meter 12 is operating in stand-alone mode, the appropriate signal is sent to any associated sound level indicator 22 to display the appropriate signal. If the sound pressure level meter 12 is operating in networked mode, the value is sent to the server 32 over the network and the server 32 takes care of lighting the appropriate sound level indicator(s) 22.

When operating in networked mode, the server 32 may request the sound pressure level meter 12 to return the audio data in the frequency domain. This can be accomplished by performing an FFT or Fast Fourier Transform on a set of audio samples.

As in the exemplary method without using an FFT, the audio signal from the universal microphone input board 300 is sampled at a rate of 80 kHz (one sample taken every 12.5 μs). The sample is digitized as a 12-bit representation of the signal level, ranging from 0 to 4095 (with 0 to 2048 representing −1.5 VDC to 0 VDC and 2048 to 4095 representing 0 VDC to 1.5 VDC), giving the ADC counts a resolution of 732.6 μV.

The samples are then A weighted by applying the A weighting gain equation to each point. The A weighting gain equation used in the current embodiment is:

$$G_A(s)=\frac{(K_A*s^4)}{(s+129.4)^2(s+676.7)(s+4636)(s+76655)^2}$$

where $K_A=7.39705\times10^9$.

After applying the A weighting gain equation, the samples are stored in arrays. A finite Fourier transform (FFT) is performed on the time domain samples. The result is a set of magnitude readings at discrete frequencies representing the sound sample in the frequency domain. The frequency samples can range from 0 to 40 kHz. Using a 20 kHz filter on the input, an interesting part of the frequency domain is contained in the data points representing 0 to 10 kHz.

The frequency domain data represents the A-weighted frequencies of the sound pressures detected by the universal microphone input board 300 at the sound pressure level meter 12. The sound pressure level meter 12 utilizes an FFT on a set of discrete time sample data. The resulting values are A-weighted before transmitting them to the server 32. The parameters driving the FFT calculations are part of the sound pressure level meter firmware and, in some embodiments, are not configurable through the server interface. The server interface does allow the user to control how often the frequency data is transmitted by the SPL and over what interval of time. The recorded data can be played back or exported.

Multiple FFTs can be calculated and combined before sending the data from the sound pressure level meter 12 to the server 32. When sampling at 80 kHz, it takes 6.4 ms to capture 512 samples. In the exemplary embodiment, the FFT results are sent to the server 32 at a maximum rate of 10 per second (one set of FFT results every 100 ms). This means that at least 15 sets of FFT results can be captured before sending the data to the server 32. The maximum magnitude at each frequency over the 15 FFTs can be combined to represent the maximum sound power for the 100 ms time period.

Figure 8:
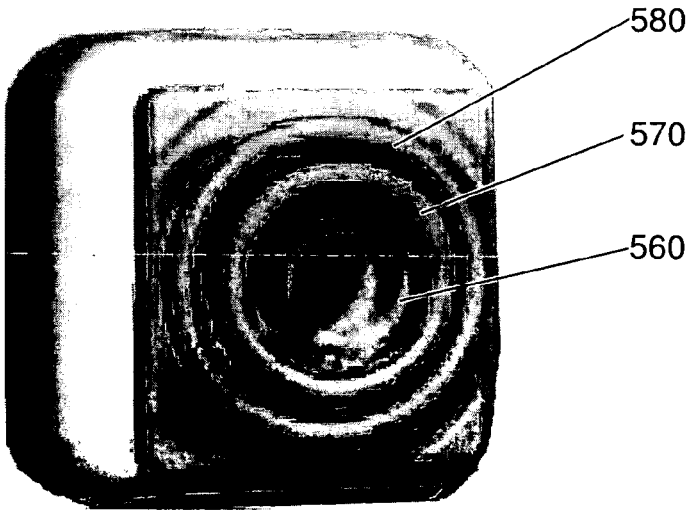
FIG. 8 shows an exemplary embodiment of a sound level indicator.

An exemplary embodiment of a sound level indicator 22 is shown in FIG. 8. This embodiment includes a green light 560, a yellow light 570 and a red light 580. The lights can be implemented by various methods including LEDs. In this embodiment the lights 560, 570, 580 are configured as concentric circular lights. The lights can be implemented in various configurations and shapes, including vertical, similar to a traffic light, horizontal or various other shapes and configurations. The level of noise can also be indicated in other ways than with red, yellow and green lights, for example by numbers representing sound level, or by controlling the room lighting to dim or brighten room lights with sound level changes. The present description refers primarily to the embodiment of the sound level indicator shown in FIG. 8.

Each of the sound level indicators 22 can include a separate light emitting diode (LED) that indicates the status of the device based on its color and blinking rate. One color and blinking rate can indicate that the device is attempting to obtain an IP address, another to indicate that it has obtained an IP address and is attempting to connect to the server 20, and yet another to indicate that it has a valid connection to the server 20. If the server connection is lost for a predetermined time, for example more than 10 seconds, the LED can indicate loss of connection until the device can regain connection to the server.

The name of a sound level indicator 22 used in the system defaults to "SLI" with a numeric value appended but can be easily edited by the user. This name is used throughout the software to represent the sound level indicators 22 to the user. Each sound level indicators 22 is related to the physical device by the device serial number. When adding or modifying an SLI icon, the physical SLI device is selected by the user from a list of sound level indicators 22 recognized by the system. Sound level indicators 22 are usually assigned to one zone or group.

When operating in stand-alone mode, the lights of the sound level indicator 22 are controlled by the sound pressure readings of an associated sound pressure level meter 12. When operating in network mode, the lights of the sound level indicator 22 are controlled over the network by the server 32.

The sound monitoring system 10 can also be used to monitor and control other systems. An RS-485 port or other appropriate interface can be used to communicate with other systems. The sound monitoring system 10 can interface with the lighting system of the monitored area to implement diurnal lighting, which dims and brightens based on the time of day. This can be implemented by user input of the local zip code, area code, latitude/longitude, or geographic indicator. The system 10 can then control the lights to track the normal outside daily light cycle.

The sound monitoring system 10 can also interface with the lighting system to dim or brighten lights based on noise level and diurnal lighting. When the lights are at normal levels, and the sound level is above a selected threshold for a selected period of time, the system can begin dimming the lights to get the attention of the persons in the area. With a diurnal lighting system, the lights may already be dimmed to simulate a nighttime environment. In this case, when the sound level is above the selected threshold for the selected period of time, the system can begin brightening the lights to get the attention of the persons in the area. Alternatively, or if the sound level remains above the selected threshold for a longer selected period of time, the system can begin flashing the lights to get the attention of the persons in the area.

The sound monitoring system 10 can also have a camera associated with a microphone unit 300 to record visual information. The camera can be positioned to view an area where the microphone unit 300 is monitoring the sound level. The camera could also include a swivel or other movable mount to view a larger portion of the area when activated. If the microphone unit 300 senses a particular sound level, either above or below a selectable threshold for a selectable period of time the camera is activated or deactivated. The user can select whether the activation/deactivation is above or below the selectable threshold. For example, in an infant care environment, the care giver may want the camera activated when conditions are quiet, the sound level is below a threshold for a certain period of time, and deactivated when conditions are active, the sound level is above a threshold. The camera may be used to try to identify the source of the noise disturbance. In this case, the camera would be activated for a selected period of time when the noise level exceeds a selected threshold and deactivated after that period of time. In this case, the camera could include a movable mount to view a larger portion of the area when the activating sound is detected.

The software on the system server 32 can control multiple floors or widely separated areas within a facility. The facility can be broken up into one or more areas for monitoring, and each area divided into zones or groups of zones. Each area can have a floor plan, and has one or more devices assigned to it.

Figure 9:
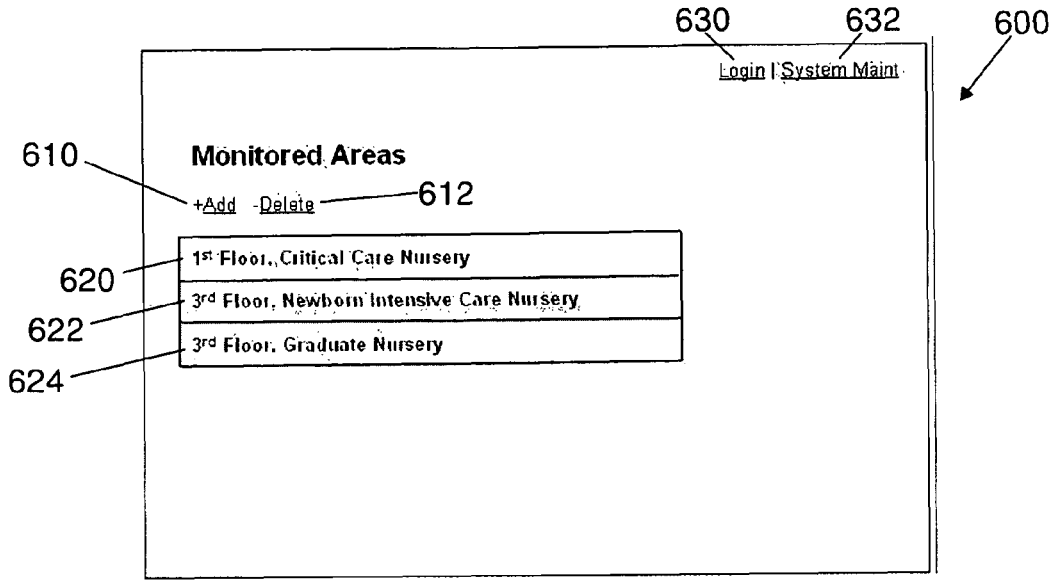
FIG. 9 illustrates an exemplary top level screen of a user interface for selection and modification of monitored areas.

FIG. 9 illustrates an exemplary embodiment of a top level screen 600 for the system software. The user can be required to enter login and password information to access this screen. The user must be logged in and have proper permissions to edit, add or delete a monitored area. From the screen 600, the user can select a login option 630 to be presented with a login screen through which the user can enter the system under a different login, with or without different authorizations. The user can also select a system maintenance option 632, from which an authorized user can perform system maintenance functions.

The top level screen 600 shows three monitored areas 620, 622, 624. Selecting the add option 610 will bring up an area screen with a blank floor plan and no devices assigned to the area. Selecting the delete option 612 will cause the system to prompt the user before continuing with the deletion of a monitored area, and if the user continues, the system will delete the monitored area selected by the user from the system. Selecting one of the monitored areas 620, 622 or 624 will open an area screen associated with that monitored area.

Each zone has one or more sound pressure level meters 12 and one or more sound level indicators 22 assigned to it. The sound monitoring system 10 can be configured such that all sound level indicators 22 within a zone display the most critical level of any sound pressure level meter 12 within that zone. Alternatively, the sound monitoring system 10 can be configured such that all sound level indicators 22 within a zone display the average value of all sound pressure level meters 12 within that zone. The zones can be identified by unique names entered by the user or by default values generated by the system. The system generates a list of sound pressure level meters 12 and sound level indicators 22 that the system recognizes in the network. For each zone, the user can select the sound pressure level meters 12 and the sound level indicators 22 to include in that zone, and place the icon for the selected device on the floorplan.

Zones have the same configuration parameters as standalone, non-networked, sound pressure level meters 12. These configuration parameters include: Yellow Threshold in dB(A), Red Threshold in dB(A), Minimum Acquisition Time and Minimum Indicator on Time. The zone configuration overrides the local configuration file of sound pressure level meters 12 assigned to that zone. The meter level indicator 330 still reflects the sound level measured by its associated sound pressure level meter 12.

The coverage of the sound monitoring system 10 can also be divided into groups that include one or more zones. The user can select the zones to be included in the group from a list of zone names recognized by the system. The sound monitoring system 10 can be configured such that all sound level indicators 22 within a group display the most critical level of any sound pressure level meter 12 within that group. Alternatively, the sound monitoring system 10 can be configured such that all sound level indicators 22 within a group display the average value of all sound pressure level meters 12 within that group.

The user interface is browser based with the central operating screen being the monitored area screen for a selected area. The monitored area screen shows a floor-plan of the selected area with icons representing the devices (sound pressure level meter 12 or sound level indicator 22), zone and group assignments. With the exception of system maintenance features, all functionality can be reached by 'drilling down' on the device icons or zone or group names. Icons and colors are used at the top-most level to quickly convey the real-time status of the system. Icons and device names, where applicable, are active and allow the user to drill down into the deeper details of the selected device.

Figure 10:
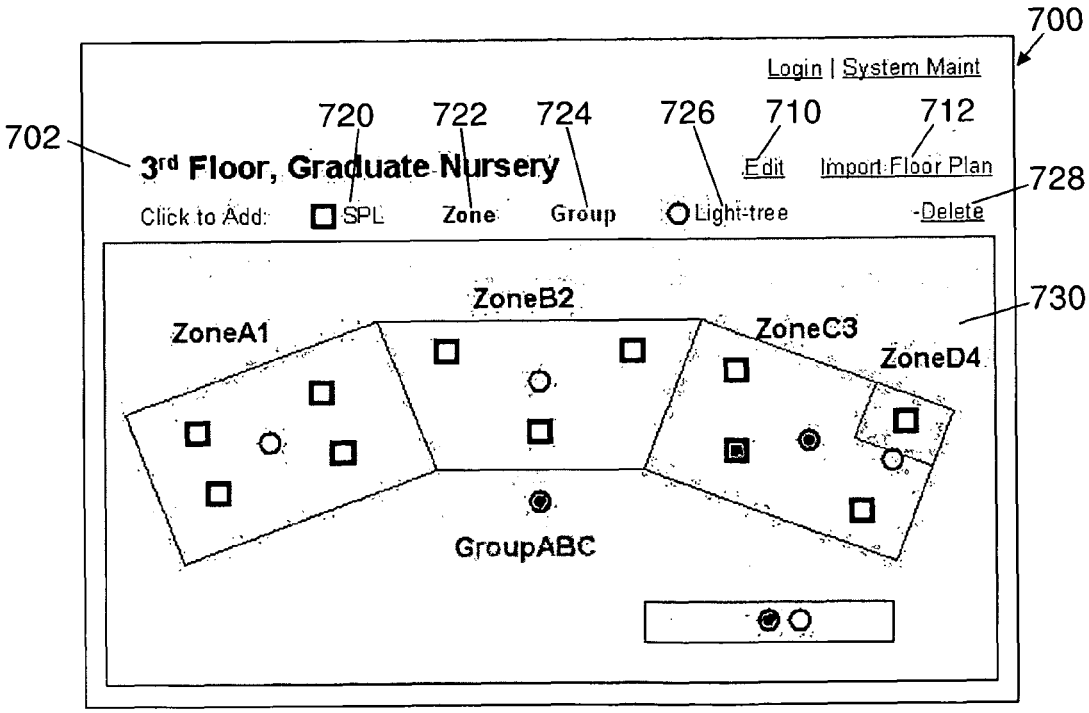
FIG. 10 illustrates an exemplary area screen window showing the status of the sound monitoring system in a selected area and enabling modification of the sound monitoring system in the area.

FIG. 10 illustrates an embodiment of an area screen 700 brought up by the user selecting the "3$^{rd}$ Floor, Graduate Nursery" option 624 on the top level screen 600. The area screen 700 includes the area name 702 and a floor plan 730 for the area. The area screen 700 has an import floor plan option 712 that enables the user to import a new or revised floor plan for the area to be used as background for placing devices of the sound monitoring system 10. The area screen 700 also has an edit option 710 that enables the user to edit the floor plan for the area, or to edit or move a device, zone or group in the area.

The area screen 700 has an add SPL option 720 to add a sound pressure level meter 12 in the area, an add Zone option 722 to add a zone in the area, an add Group option 724 to add a group in the area, and an add Light-tree option 726 to add a sound level indicator 22 to the area. The area screen also has a delete option 728 to delete a selected device, zone or group from the area. In general, adding a zone, group or device requires clicking the appropriate add option 720-726, clicking the location on the floor plan to add the new object, and filling out the properties form that pops up for the new object. The properties form will include fields for entry and selection of the necessary information for the new object.

When creating a new monitored area, the sound pressure level meters 12 and sound level indicators 22 are first physically installed and any networked devices are connected to the network. These networked devices are automatically detected by the system and made available for assignment by the user to a desired area. The user can select the import the floor plan option 712 to import a floor plan for the area.

The user can then select the add SPL option 720 for each sound pressure level meter 12 to be added to the area. For each sound pressure level meter 12 to be added, an SPL properties form is filled out including selection of a sound pressure level meter 12 recognized by the system. The user then places the icon for the new sound pressure level meter 12 on the floor plan.

After the sound pressure level meters have been added, the user can add zones to the area by selecting the add Zone option 722. For each new zone, a zone properties form is filled out in which the user names the zone and selects to sound pressure level meters 12 in the area to be included in the zone; and the boundaries for the zone are designated on the floor plan.

After the zones have been added, the user can add groups to the area by selecting the add Group option 724. For each new group, a group properties form is filled out in which the user names the group and selects to zones in the area to be included in the group.

After the groups have been added, the user can add sound level indicators 22 to the area by selecting the add Light-tree option 726. For each sound level indicator 22 or light tree, an SLI properties form is filled out including selection of a sound level indicator 22 recognized by the system and associating the sound level indicator 22 with a group, zone or sound pressure level meter 12 in the area. The user then places the icon for the new sound level indicator 22 on the floor plan.

The floor plan 730 of FIG. 10 shows that the "3$^{rd}$ Floor, Graduate Nursery" area is divided into four zones: ZoneA1, ZoneB2, ZoneC3, and ZoneD4, and one group, GroupABC. Four sound pressure level meters 12 and one sound level indicator 22 are assigned to ZoneA1; three sound pressure level meters 12 and one sound level indicator 22 are assigned to ZoneB2; three sound pressure level meters 12 and one sound level indicator 22 are assigned to ZoneC3; one sound pressure level meter 12 and one sound level indicator 22 are assigned to ZoneD4; and one sound level indicator 22 is assigned to GroupABC.

The area screen 700 also displays the real-time status of each of the devices in the area. The icons for the sound pressure level meters 12 and the sound level indicator 22 represent the current color of the sound level indicator 22 or meter level indicator 330 for the device. All of the sound pressure level meters 12 in ZoneA1 are in the green range, and the sound level indicator 22 for ZoneA1 displays a green signal. Two of the sound pressure level meters 12 in ZoneB2 are in the green range and one is in the yellow range, and the sound level indicator 22 for ZoneB2 displays a yellow signal. In Zone C3, one of the sound pressure level meters 12 is in the green range, one in the yellow range, one in the red range, and the sound level indicator 22 for ZoneC3 displays a red signal. The sound pressure level meter 12 in ZoneD4 is in the yellow range, and the sound level indicator 22 for ZoneD4 displays a yellow signal. GroupABC includes ZoneA1, ZoneB2 and ZoneC2, and since one of the sound pressure level meters 12 in ZoneC3 is in the red range, the sound level indicator 22 for GroupABC displays a red signal.

The area screen 700 can also display a more detailed status of any device in the area by selecting the device of interest. Hovering over an icon for a sound pressure level meter 12 or a sound level indicator 22, or hovering over a zone or group name, brings up the name assigned to that item, its zone or group affiliations and its current state. Selecting an icon for a sound pressure level meter 12 or a zone or group name opens a screen with the properties for that item, along with sound pressure level graphs for the item.

Figure 11:
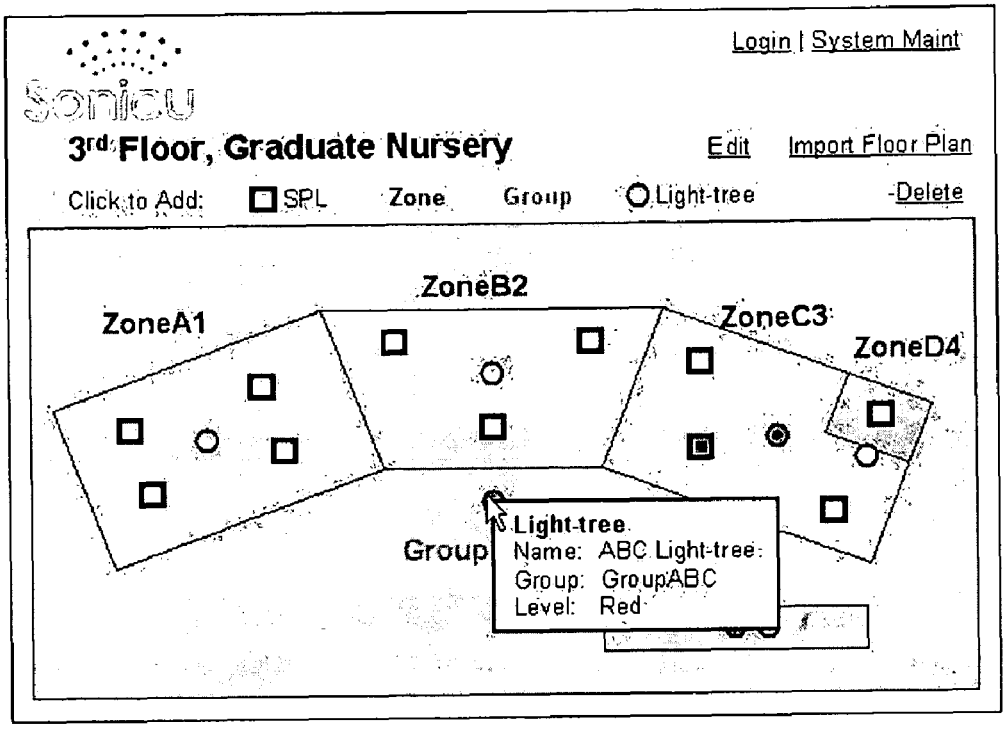
FIG. 11 illustrates the exemplary area screen window and a status window that appears with the cursor hovering over a sound level indicator icon.

FIG. 11 shows an example of the display when hovering over a sound level indicator 22. Hovering over this icon brings up a window that shows the light-tree or sound level indicator 22 is named "ABC Light-tree," is assigned to GroupABC, and that it is currently displaying a red signal.

Figure 12:
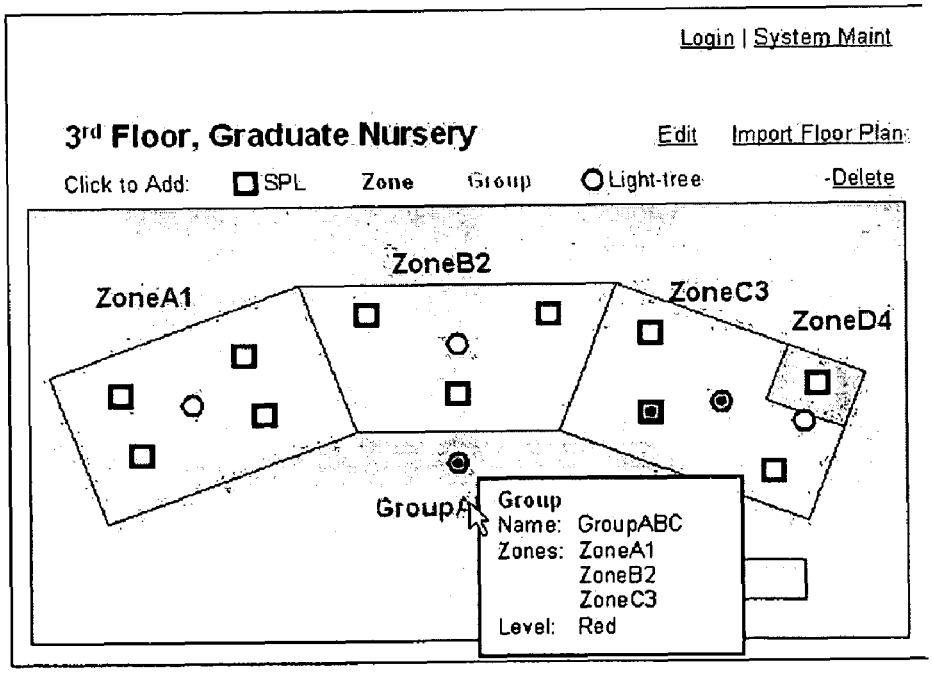
FIG. 12 illustrates the exemplary area screen window and a status window that appears with the cursor hovering over a group name.

FIG. 12 shows an example of the display when hovering over the name for GroupABC. Hovering over this name brings up a window that shows the group is named "GroupABC"; this group includes zones ZoneA1, ZoneB2 and ZoneC3; and that it is currently in a red signal state.

Figure 13:
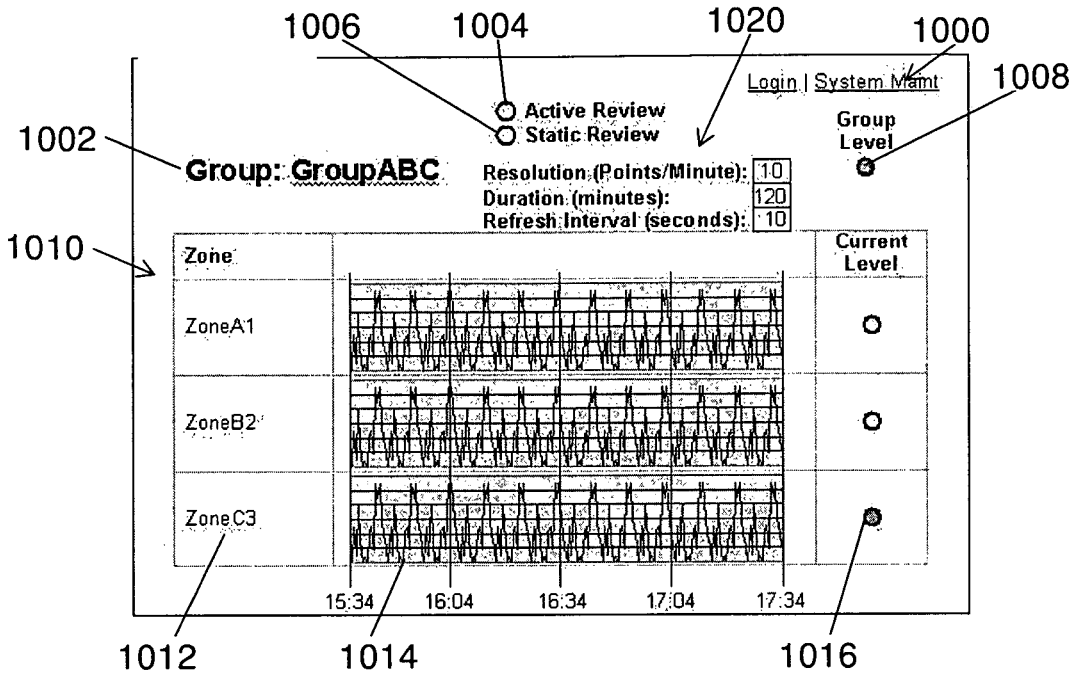
FIG. 13 illustrates an exemplary group window in active review mode displaying current sound level readings for a selected group.

FIG. 13 shows an example of a group window 1000 when selecting GroupABC from the area screen 700. The group window 1000 provides the name 1002 of the selected group, an Active Review indicator 1004, a Static Review indicator 1006, and a current group level indicator 1008. The group window 1000 also includes graphing parameters 1020, and a table 1010 with a row for each zone in the group, each row displaying a zone name 1012, a graph 1014 of the sound level in that zone, and a current zone level indicator 1016. The current group level indicator 1008 shows the sound level reading for the group and the current zone level indicator 1016 in each row of table 1010 shows the current sound level reading in the zone of that row.

Note that the Active Review indicator 1004 is selected in the active group window 1000. Current sound pressure information is displayed in the graphs 1014 when the Active Review indicator 1004 is selected, and historical sound pressure information is displayed in the graphs 1014 when the Static Review indicator 1006 is selected. In this exemplary embodiment of the system, the control options are also different depending on the selection of Active or Static Review, as will be shown with reference to FIGS. 13 and 14.

When the Active Review indicator 1004 is selected, as in FIG. 13, the graphs 1014 in table 1010 show current sound pressure information. Each graph 1014 displays the sound pressure levels over time in dB(A) sensed in the zone for that row. The dB(A) reference levels are marked and labeled at the left side of each graph (not shown), and time is marked and labeled at the bottom of the graphs. The time frame shown in the graphs 1014 is controlled by the graphing parameters 1020 which include fields for the resolution and duration of the graphs, and refresh interval for updating the graphs. Each of the graphs 1014 in the table 1010 is active in that hovering the cursor over a point in a graph pops up a window displaying the time, date and value for the selected point.

Figure 14:
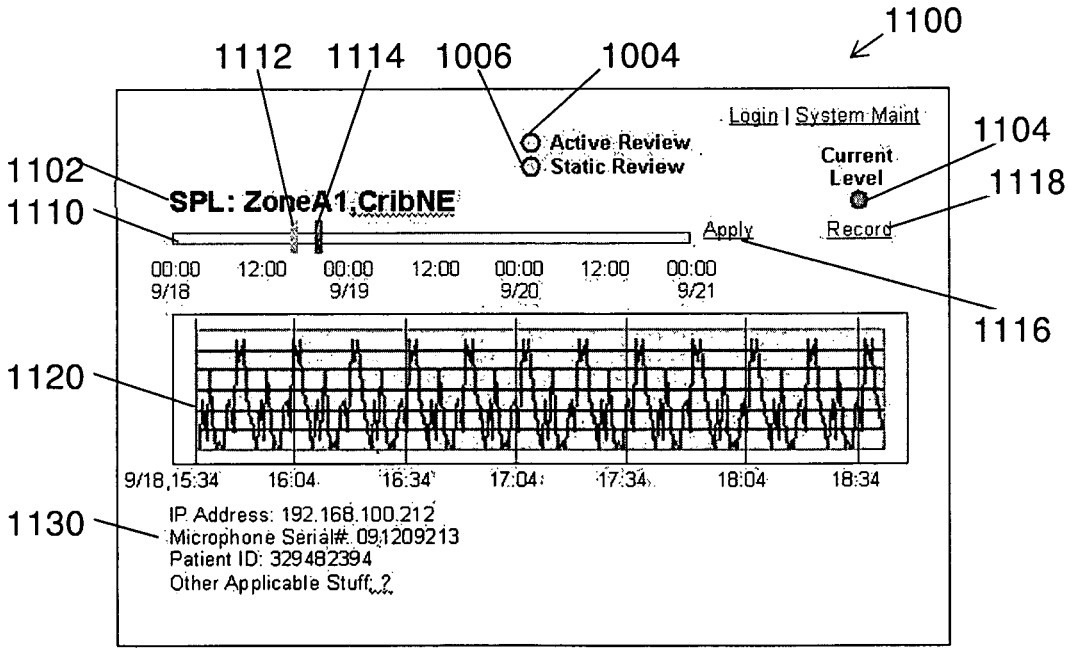
FIG. 14 illustrates an exemplary sound pressure meter window in static review mode displaying historical sound level readings for a selected sound pressure meter.

FIG. 14 shows an example of a static SPL window 1100 when selecting one of the sound pressure level meters 12 in ZoneA1. The static SPL window 1100 provides the name 1102 of the selected sound pressure level meter 12, the Active Review indicator 1004, the Static Review indicator 1006, and a current level indicator 1104. The static SPL window 1100 also provides a timeline 1110, a start marker 1112, an end marker 1114, an apply option 1116, and a graph 1120 of sensed sound pressure readings. The static SPL window 1100 also includes a record option 1118, and an information section 1130 with information relevant to the selected sound pressure level meter 12 such as its IP address, and the serial number of its universal microphone board 300. Note that the Static Review indicator 1006 is selected in the static SPL window 1100, thus in this exemplary embodiment, a timeline 1110 and associated controls is displayed instead of graph control parameters 1020 as shown in FIG. 13.

Since the Static Review indicator 1006 is selected in the static SPL window 1100, the graph 1120 shows historical sound pressure information. The graph 1120 displays the sound pressure levels over time in dB(A) sensed by the selected sound pressure level meter 12. The start marker 1112 and stop marker 1114 can be moved along the timeline 1110 to display sound levels sensed over different time frames in the graph 1120. The graph 1120 is active in that hovering the cursor over a point in the graph pops up a window displaying the time, date and value for the selected point. Selecting the Record option 1118 on the SPL screen 1100 opens the record/playback screen for the selected SPL.

Figure 15:
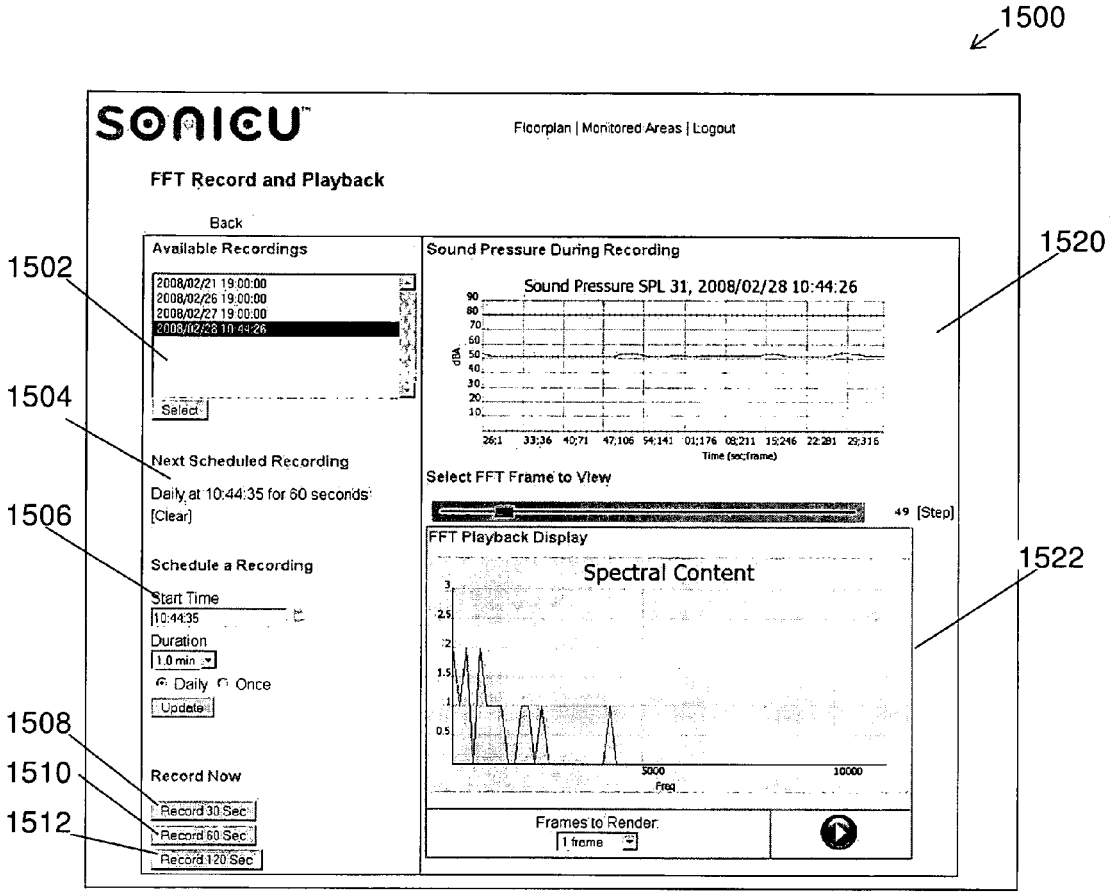
FIG. 15 illustrates an exemplary FFT record and playback window.

An FFT (Fast Fourier Transform) Record and Playback page 1500 is shown in FIG. 15. The FFT Record and Playback page 1500 includes a list of stored recordings 1502 that can be displayed and analyzed, and a number of recording parameters. The recording parameters include a field 1504 showing when the next scheduled recording is to take place; fields 1506 to schedule a recording; and buttons to start a recording upon selection. In the embodiment shown in FIG. 15, the schedule a recording fields 1506 include a start time field, a duration field, a selection for selecting whether the recording should be done at the scheduled start time every day or only once at the next occurrence of the start time, and an update button. When the update button is selected, a recording is scheduled at the selected start time for the selected start time either once or daily, as selected. In the embodiment shown in FIG. 15, the buttons to start a recording upon selection include a button 1508 to start a recording for the next 30 seconds, a button 1510 to start a recording for the next 60 seconds, and a button 1512 to start a recording for the next 120 seconds.

The FFT Record and Playback page 1500 also includes a sound pressure graph area 1520 and a spectral content graph area 1522. The sound pressure graph area 1520 can show a graph of the sound pressure currently being recorded or a graph of an available sound pressure recording selected in the list of stored recordings 1502. The spectral content area 1522 shows a plot of the spectral content of the sound pressure graph displayed in the sound pressure graph area 1520. The graph in the spectral content area 1522 shows the frequency range of sounds to which a microphone 300 of the system is being exposed, and the graph in the sound pressure graph area 1520 shows the magnitude of the sound. In addition to determining the frequencies of a sound that a microphone 300 is detecting, it is also helpful to determine how much of that sound is in a particular frequency range. For example, in a NICU environment, a mother might be as loud as she wants because her voice has a certain frequency distribution, but the hum of a piece of equipment may prove to be more stressful because it has a different frequency distribution. All frequencies are not equally acceptable, and the graphs on the FFT Record and Playback page 1500 display both the level and magnitude of the sound pressure.

Sound Pressure Level recording and playback is controlled at the sound pressure level meter 12 device level. For a given sound pressure level meter 12, the user can select to record data once at a given time or at a set time on a daily basis, or in case of a selected event, such as reaching or exceeding the red threshold level. The recorded data is stored with a time and date stamp. To facilitate synchronizing the recorded data with data from other instruments, the system will, when connected to an external network or the world wide web, access a time serving website to set its own time and date. Recorded data is available for playing back in a graphical manner, exporting to other programs (for example, Microsoft Excel), deleting or annotating.

The database, usually located with the server 32, contains all user and system configuration information. In addition, the database is used to record sound pressure level meter 12 data at the resolution and for the interval established in the sound pressure level meter configuration. Sound pressure data is transmitted from the sound pressure level meter 12 in one of two formats, frequency domain data or sound pressure level data. In either case, the A-weighted filter is applied before the sound pressure level meter 12 transmits the data.

The sound pressure level data can be reported by the sound pressure level meters 12 in dB(A) and handled throughout the system in dB(A). The rate at which the sound pressure level meters 12 report their current sound pressure level data and how long that data is kept can be configured under the database maintenance screens.

Device maintenance tasks include allowing users to ping devices, remove devices, view current devices along with their firmware versions and upgrade device firmware. User maintenance tasks include adding and removing users as well as establishing the permissions assigned to each user. Data maintenance tasks include purging database data and establishing limits on the length of time data is stored. Any sound pressure level meter 12 or network interface 30 in the system can be upgraded through the server interface. The current firmware version of any microcontroller or microprocessor in the system can be viewed through the device maintenance screens.

Figure 16:
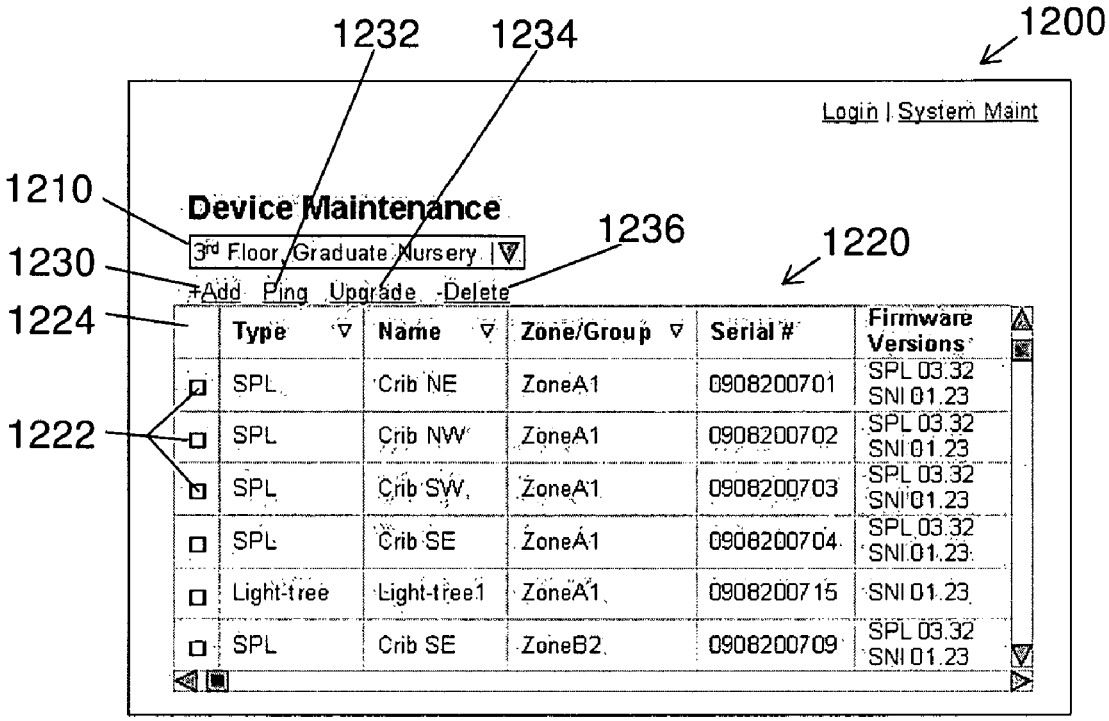
FIG. 16 illustrates an exemplary maintenance interface window for a selected area.

FIG. 16 shows an example of a maintenance interface screen 1200 accessed by selecting the System Maintenance option. The maintenance interface screen 1200 includes a pull down menu 1210 to select different areas covered by the system. For the area selected a scrollable table 1220 is populated with a row for each device in the selected area. Multiple devices can be selected at once by utilizing the checkboxes 1222 down the left side of the table 1220. Devices can be sorted by type, name, zone/group name or IP address by selecting the desired column title in the header row 1224 of the table 1220. Selecting a device name in the table 1220 brings up a properties window for the selected device. Properties displayed in the table 1220 can include type, name, zone/group assignment, serial number, firmware version and IP address.

The maintenance interface screen 1200 also includes an add option 1230, a ping option 1232, an upgrade option 1234 and a delete option 1236. The user can ping a device by selecting the desired device in the table 1220 and selecting the ping device option 1232. The user can upgrade the firmware in a device by selecting the desired device in the table 1220 and selecting the upgrade option 1234.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains.

I claim:

1. A sound monitoring system comprising:

a plurality of sound pressure level meters, each of the plurality of sound pressure level meters measuring a sound level at its location;

a plurality of sound level indicators, each of the plurality of sound level indicators providing a visual indication of the sound level measured by at least one of the plurality of sound pressure level meters;

a server; and a network connecting the plurality of sound pressure level meters, the plurality of sound level indicators and the server to enable communication therebetween;

wherein each of the plurality of sound pressure level meters and sound level indicators receives power through the network;

wherein the network includes a power supply, wherein the power supply accepts input power from a local source, conditions the input power to create conditioned power compatible with the plurality of sound pressure level meters and sound level indicators, and supplies the conditioned power to each of the plurality of the sound pressure level meters and sound level indicators through the network.

2. A sound monitoring system comprising:

a plurality of sound pressure level meters, each of the plurality of sound pressure level meters measuring a sound level at its location;

a plurality of sound level indicators, each of the plurality of sound level indicators providing a visual indication of the sound level measured by at least one of the plurality of sound pressure level meters;

a server; and a network connecting the plurality of sound pressure level meters, the plurality of sound level indicators and the server to enable communication therebetween;

wherein at least one of the plurality of sound pressure level meters includes a multimedia card interface, the multimedia card interface enabling parameter download and data upload between the at least one of the plurality of sound pressure level meters and a multimedia card.

3. A sound monitoring system comprising:

a plurality of sound pressure level meters, each of the plurality of sound pressure level meters measuring a sound level at its location;

a plurality of sound level indicators, each of the plurality of sound level indicators providing a visual indication of the sound level measured by at least one of the plurality of sound pressure level meters;

a server; and a network connecting the plurality of sound pressure level meters, the plurality of sound level indicators and the server to enable communication therebetween;

wherein user-selectable parameters include an acquisition time and an indicator-on time, the acquisition time controlling how long the sound level must exceed a threshold level before an indication is activated, and the indicator-on time controlling the minimum time the indication can be is activated once it is triggered.

* * * * *